United States Patent [19]

Ogawa et al.

[11] 4,177,586

[45] Dec. 11, 1979

[54] YELLOWING RESISTANT LABEL COMPRISING A POROUS POLYAMIDE LAYER CONTAINING A PLASTICIZER

[75] Inventors: Shigeru Ogawa, Kyoto; Kenzi Uemura, Kameoka; Masao Tanida, Kyoto, all of Japan

[73] Assignee: Dynic Corporation, Kyoto, Japan

[21] Appl. No.: 829,212

[22] Filed: Aug. 31, 1977

[30] Foreign Application Priority Data

Jun. 3, 1977 [JP] Japan ..... 52-65902

[51] Int. Cl.[2] ..... B05D 1/36; B32B 5/24; B32B 5/28; B32B 31/24

[52] U.S. Cl. ..... 40/2 R; 427/354; 428/290; 428/304

[58] Field of Search ..... 427/354; 428/290, 304; 40/2 R

[56] References Cited

U.S. PATENT DOCUMENTS

| | | | |
|---|---|---|---|
| 3,449,153 | 6/1969 | Saligny et al. | 427/354 |
| 3,460,969 | 8/1969 | Murphy | 427/354 |
| 3,496,000 | 2/1970 | Hull et al. | 427/354 |
| 3,524,753 | 8/1970 | Sharp | 427/354 |
| 3,527,653 | 9/1970 | Sommer et al. | 427/354 |
| 3,535,143 | 10/1970 | Shkapenko et al. | 427/354 |
| 3,619,250 | 11/1971 | Nishijima | 427/354 |
| 3,684,556 | 8/1972 | Mahl et al. | 427/354 |
| 3,846,156 | 11/1974 | Seibert et al. | 427/354 |

FOREIGN PATENT DOCUMENTS

| | | | |
|---|---|---|---|
| 37-15792 | 10/1962 | Japan | 427/354 |
| 46-2593 | 1/1971 | Japan | 427/354 |
| 46-25514 | 7/1971 | Japan | 427/354 |
| 48-19925 | 6/1973 | Japan | 427/354 |
| 1257812 | 12/1971 | United Kingdom | 427/354 |

*Primary Examiner*—James C. Cannon

*Attorney, Agent, or Firm*—Birch, Stewart, Kolasch & Birch

[57] ABSTRACT

A yellowing resistant label to be attached to articles of clothing, bedclothes, sundry goods or the like which comprises a fabric base and a porous nylon resin layer formed on the surface of the base, said nylon resin coating composition being prepared by dissolving a nylon resin in a solution of calcium chloride in methanol and adding thereto 5 to 25 PHR of a plasticizer for a nylon resin such as 2-ethylhexyl p-hydroxybenzoate, the label is prepared by applying the nylon resin coating composition onto the fabric base, dipping the coated base into water in order to leach out methanol and calcium chloride from the coating composition and then drying the resultant.

8 Claims, No Drawings

YELLOWING RESISTANT LABEL COMPRISING A POROUS POLYAMIDE LAYER CONTAINING A PLASTICIZER

BACKGROUND AND SUMMARY OF THE INVENTION

The present invention relates to a yellowing resistant label, particularly, to a label to be attached to articles of clothing, bedclothes, sundry goods or the like.

Various labels are attached to articles of clothing, bedclothes, sundry goods or the like to indicate, for example, the name of the manufacturer, quality of the product, and matters to be noted in handling the product. For such labels, there has been employed a woven fabric label containing embroidery items or a printed label prepared by applying a coating composition, especially an aqueous coating composition, to the surface of paper, woven fabric or the like. However, such conventional labels have certain defects, for example, fraying of a trimmed edge, low printability, low dry-cleaning resistance and low water resistance, and further, some of them are too expensive.

It has been previously found that a label without the above defects can be obtained by utilizing a wet method for forming a surface coat on a base known to the synthetic leather art. For instance, a label without the above defects is obtained by applying a coating composition, which is prepared by dissolving a nylon resin in a solution of calcium chloride in methanol, onto a surface of a fabric base and dipping it into water to form a porous nylon surface thereon (Japanese utility model publication (unexamined) Nos. 5597/1975 and 55195/1977), or by dipping a nylon fabric into a solution of calcium chloride in methanol to etch the surface of the fabric and to form a porous surface (Japanese utility model publication (unexamined) Nos. 111479/1975 and 46699/1977).

The labels prepared by such processes have many advantages and hence the demand therefor has recently been increased. For instance, the labels have a high printability owing to the white porous surface. A printing ink can be spreaded well on the porous surface thereof and a clear printed label can be provided. Furthermore, they can be used in the form of a rolled sheet having a desired width. That is, by printing on the porous surface of the rolled sheet and cutting it in a desired length, they can be attached to products such as articles of clothing, bedclothes or sundry goods during the manufacturing process thereof. The trimmed ends of the labels are hardly frayed.

However, the labels tend to yellow when they are stored in the form of a rolled sheet or after being attached to the products. This phenomenon results from their contact with a cellophane tape used for packaging a rolled sheet or a rubber material such as a rubber string used in the products to which the labels are attached. Hereinafter, this yellowing is referred to as "rubber-inducing yellowing".

It is an object of the present invention to prevent the rubber-inducing yellowing of the label. Another object of the present invention is to provide a rubber-induced yellowing resistant label. These and other objects of the present invention will become appear from the following description.

Generally, it is known that a nylon product tends to yellow due to an oxidative effect of light and air. However, according to our study, it is assumed that the rubber-inducing yellowing is different from the above yellowing due to an oxidative effect of light and air, but rather may be due to the action of a component, especially an antioxidant, of a cellophane tape used for packaging a rolled sheet or a rubber material used in the various products. The reason for this conclusion is that the rubber-inducing yellowing remarkably occurs at that portion where the label is contacted with the cellophane tape or with the rubber material.

According to the present invention, we have unexpectedly found that the rubber-inducing yellowing is prevented by incorporating a substance usually used as a plasticizer for a nylon resin into the coating composition.

In a wet method for forming a surface coat in the snythetic leather art, a plasticizer is usually added to a nylon resin coating composition in an amount of 20 to 50 PHR (parts per hundred parts of resin) to prevent a surface crack, to improve hand and feel of a product or the like. However, in a label, it is not necessary to consider the prevention of a surface crack, improvement of hand and feel of a product or the like since the coating thickness of the composition is very thin. On the contrary, when a plasticizer is added to a coating composition used in a process for producing the label, it causes some problems such as deterioration of the film-forming property of the composition, lower printability of the label and slow solidification of a nylon resin used in the composition which lowers productivity of the label. Therefore, it is rather preferable not to add a plasticizer to a coating composition used in a process for producing the label.

Nevertheless, it has been recently found that the rubber-inducing yellowing of the label can be prevented without lowering printability, productivity or the like by adding a plasticizer for a nylon resin to the coating composition in an amount smaller than that commonly used for a coating composition in a wet method for forming a surface coat of the synthetic leather.

According to the present invention, there is provided a rubber-inducing yellowing resistant label comprising a fabric base and a porous nylon resin layer formed on the surface of the base. The desired rubber-inducing yellowing resistant label can be prepared by applying a nylon resin coating composition containing 5 to 25 PHR of a plasticizer for a nylon resin, dipping the coated base into water in order to leach out methanol and calcium chloride from the coating composition, and then drying the resultant. Although the mechanism is not clear, it is seemed that the plasticizer added to the coating composition of the present invention does not act as an actual plasticizer, but acts as an agent to prevent rubber-inducing yellowing of the label. According to the present invention, printability and productibity of the label are not lowered even by the incorporation of the plasticizer, since the amount of the plasticizer is smaller than commonly used in a coating composition for artificial leathers.

The desired rubber-inducing yellowing resistant label of the present invention may be prepared as follows. A nylon resin coating composition prepared by dissolving a nylon resin in a solution of calcium chloride in methanol and adding thereto 5 to 25 PHR of a plasticizer for a nylon resin is applied onto a surface of a fabric base in a coating weight of about 60 to 130 g/m$^2$, preferably 70 to 120 g/m$^2$. Subsequently, the calcium chloride and methanol contained in the coated nylon resin layer are leached out according to a known wet method for forming a surface coat. That is, the coated base is dipped into water to leach out calcium chloride and methanol at about 40 to 50° C. for about 3 to 5 minutes and thereby the surface of the coated layer becomes porous. Thereafter, the resulting coated product is dried to give a sheet having a nylon porous surface layer. The sheet thus obtained is appropriately printed and cut in a suitable size. The nylon surface layer thus formed contains about 5 to 25 PHR of the plasticizer for a nylon resin and as a result thereby, an excellent rubber-inducing yellowing resistance is given to the label of the present invention.

The fabric base used in the present invention may be any one of woven fabric, nitted fabric and nonwoven fabric. The fiber used in the fabric is not critical and is, for example, cotton, rayon, polyester, nylon or the like. It is preferable to use a nylon fiber alone or a blend with another fiber since adhesion between the base and the nylon porous layer is improved, and fraying of the trimmed ends of the label is more effectively prevented by biting the coating composition into the nylon fiber of the base.

The nylon resin coating composition used in the present invention is prepared by dissolving a nylon resin in a solution of calcium chloride in methanol and adding thereto 5 to 25 PHR, preferably 7.5 to 17.5 PHR, of a plasticizer for the nylon resin, and optionally adding a filler such as calcium carbonate or the like to improve absorption of a printing ink. As mentioned above, when a greater amount of a plasticizer for nylon resin is used, printability and productivity of the label of the present invention are lowered. On the other hand, when a smaller amount of a plasticizer is used, a rubber-inducing yellowing resistance of the label of the present invention is not sufficient. The amount of the other components of the coating composition is not critical but it is preferable to add 20 to 30% by weight of calcium chloride, 50 to 60% by weight of methanol and 15 to 30% by weight of a nylon resin on the basis of the whole weight of the coating composition.

The plasticizer for a nylon resin may be any one of the conventional plasticizers. For example, a carboxylic acid ester plasticizer such as 2-ethylhexyl p-hydroxybenzoate or a sulfonamide plasticizer such as N-ethyl-o- or p-toluene-sulfonamide, preferably 2-ethylhexyl p-hydroxybenzoate is used.

As the nylon resin used in the coating composition, 6-nylon or 6,6-nylon is preferable. Use of a large amount of type-8-nylon (N-methoxymethylnylon) induces some disadvantages, such as delaying the solidification of the resin, decreasing porosity of the surface and lowering productivity and printability due to its chemical properties. However, it has been found that a small amount of type-8-nylon, for example, 1.8 to 5.5% by weight of type-8-nylon on the basis of the total weight of the nylon resin used in the coating composition improves the rubber-inducing yellowing resistance of the label in cooperation with the plasticizer in the coating composition. Therefore, it is preferable to use 6-nylon or 6,6-nylon in combination with type-8-nylon in the above ratio.

The present invention is illustratively shown in the following Examples wherein parts are by weight.

EXAMPLE 1

| Components | Parts |
|---|---|
| 6-Nylon | 20 |
| Methanol | 58 |
| Calcium chloride | 24 |
| Calcium carbonate | 7 |
| 2-Ethylhexyl p-hydroxybenzoate | 2 |

According to the above formulation, a coating composition is prepared by dissolving calcium chloride in methanol and adding the other components to the resulting solution. The coating composition thus obtained is applied on the surface of a nylon woven fabric (100% of 6-nylon, 70 denier taffeta) in 90 g/m$^2$ of coating weight, dipped the coated fabric into warm water at 40° to 50° C. for 5 minutes, washed with water and dried to give a sheet having a porous nylon layer surface. The sheet is appropriately printed and cut to give a rubber-inducing yellowing resistant label.

Similarly, some sheets are prepared by using a coating composition containing a various amount of a plasticizer for a nylon resin.

The degree of rubber-inducing yellowing of the above-prepared sheets is tested as follows:

A cellophane tape (length is 10 cm) was adhered to the center portion of each sample of the sheets (20×20 cm). The samples were folded and hung in a room and then daily observed the degree of rubber-inducing yellowings. After unfolding the samples, the judgment of the degree of rubber-inducing yellowing was carried out by observing yellowing at the portion to which the cellophane tape is adhered and the marginal portion thereof according to 5 steps grading method of JIS-L-0805 gray scale for discoloration (method for testing color fastness) (5: No yellowing was observed, 4: Yellowing was almost not observed, 3: Yellowing was slightly observed, 2: Yellowing was observed, 1: Remarkable yellowing was observed). As a control, a sheet prepared by using a coating composition without a plasticizer was used. The results are shown in the following Table 1.

Table 1

| Plasticizer | Amount (PHR) | Days 1 | 3 | 7 | 14 |
|---|---|---|---|---|---|
| Control | — | 5 | 3 | 2 | 2 |
| 2-Ethylhexyl p-hydroxybenzoate | 2.5 | 5 | 3 | 4 | 2 |
| | 5.0 | 5 | 4 | 4 | 3 |
| | 7.5 | 5 | 5 | 5 | 4 |
| | 10.0 | 5 | 5 | 5 | 4 |
| | 12.5 | 5 | 5 | 5 | 4 |
| | 15.0 | 5 | 5 | 5 | 4 |
| | 17.5 | 5 | 5 | 5 | 4 |
| | 20.0* | 5 | 5 | 5 | 4 |
| | 22.5* | 5 | 5 | 5 | 5 |
| | 25.0* | 5 | 5 | 5 | 5 |
| Sansosizer-N-400** | 10.0 | 5 | 4 | 4 | 4 |
| R642*** | 10.0 | 5 | 5 | 4 | 4 |

[Remarks]
*: A little deterioration of film-forming property of the composition was observed.
**: A sulfonamide plasticizer produced by New Japan Chemical, Tokyo, Japan
***: A sulfonamide plasticizer imported from England.

As shown in the above Table 1, it is clear that rubber-inducing yellowing of the label is prevented by addition of 5 to 25 PHR, preferably 7.5 to 17.5 PHR of a plasticizer for a nylon resin, especially 2-ethylhexyl p-hydroxybenzoate, to the coating composition.

EXAMPLE 2

| Components | Parts |
|---|---|
| 6-Nylon | 18 |
| Type-8-nylon | 2 |
| Methanol | 58 |
| Calcium chloride | 24 |
| Calcium carbonate | 10 |
| 2-Ethylhexyl p-hydroxybenzoate | 2 |

According to the above formulation, a coating composition is prepared and a rubber-inducing yellowing resistant label is obtained by the same procedure of Example 1. When the degree of rubber-inducing yellowing of the label was tested by a similar procedure as in the above Table 1, the degree of rubber-inducing yellowing was about 4 after 14 days.

EXAMPLE 3

| Components | Parts |
|---|---|
| 6-Nylon | 14 |
| Type-8-nylon | 6 |
| Methanol | 58 |
| Calcium chloride | 24 |
| Calcium carbonate | 10 |
| 2-Ethylhexyl p-hydroxybenzoate | 5 |

According to the above formulation, a coating composition is prepared and a rubber-inducing yellowing resistant label is obtained by the same procedure of Example 1. When the degree of rubber-inducing yellowing of the label was tested by a similar procedure as in the above Table 1, the degree of rubber-inducing yellowing was about 4 after 14 days.

When the labels in Examples 1 to 3 were attached to a rubber string portion of a pair of trousers, no rubber-inducing yellowing was observed after one year storage.

What is claimed is:

1. A label which is resistant to rubber-induced yellowing which comprises a fabric base containing a porous nylon resin layer formed on the surface thereof, said porous nylon resin layer being prepared by dissolving a nylon resin in a solution of calcium chloride in methanol and adding thereto 7.5 to 17.5 PHR of a plasticizer selected from the group consisting of a carboxylic acid ester plasticizer and a sulfonamide plasticizer and dipping the nylon coated fabric base into water to leach out the methanol and calcium chloride to form said porous layer and drying the resultant composite.

2. A label according to claim 1 wherein said plasticizer is 2-ethylhexyl p-hydroxybanzoate.

3. A label according to Claim 1 wherein said nylon resin is a member selected from the group consisting of 6-nylon and 6,6-nylon.

4. A label according to Claim 1 wherein said nylon resin comprises 6-nylon or 6,6-nylon and 1.8 to 5.5% by weight of type-8-nylon on the basis of the total resin weight.

5. A label according to Claim 1 wherein said fabric base is made of a nylon fiber alone or a blend with another fiber.

6. The label of claim 1, wherein said fabric base is made of a member selected from the group consisting of cotton, rayon, and a polyester.

7. The label of claim 1, wherein a filler is additionally added with the plasticizer.

8. The label of claim 7, wherein the filler is calcium carbonate.

* * * * *